US006283845B1

(12) United States Patent
Fischbacher et al.

(10) Patent No.: US 6,283,845 B1
(45) Date of Patent: Sep. 4, 2001

(54) GRINDING WHEEL

(75) Inventors: Markus Fischbacher, Walchsee; Hans Noichl, Kirchberg, both of (AT)

(73) Assignee: Tyrolit Schleifmittelwerke Swarovski K.G., Schwaz (AT)

( * ) Notice: Subject to any disclaimer, the term of this patent is extended or adjusted under 35 U.S.C. 154(b) by 0 days.

(21) Appl. No.: 09/446,331

(22) PCT Filed: Apr. 19, 1999

(86) PCT No.: PCT/AT99/00096

§ 371 Date: Dec. 21, 1999

§ 102(e) Date: Dec. 21, 1999

(87) PCT Pub. No.: WO99/54089

PCT Pub. Date: Oct. 28, 1999

(30) Foreign Application Priority Data

Apr. 21, 1998 (AT) ..... 673/98

(51) Int. Cl.[7] ..... B23F 21/03
(52) U.S. Cl. ..... 451/542
(58) Field of Search ..... 451/541, 542, 451/543, 545, 547, 449, 67; 125/13.02

(56) References Cited

U.S. PATENT DOCUMENTS

| | | | | |
|---|---|---|---|---|
| 2,032,362 | * | 3/1936 | Herman | 51/206 |
| 2,049,874 | * | 8/1936 | Sherk | 51/206 |
| 3,540,162 | * | 11/1970 | Blackmer et al. | 51/206 |
| 3,579,928 | * | 5/1971 | Held | 51/356 |
| 4,484,417 | | 11/1984 | Klingerman . | |
| 5,423,717 | * | 6/1995 | Boaz | 451/449 |
| 5,495,844 | | 3/1996 | Kitajima et al. . | |
| 5,507,273 | | 4/1996 | Chiuminatta et al. . | |
| 5,611,724 | | 3/1997 | deGraaff . | |
| 5,787,871 | * | 8/1998 | Jones et al. | 125/15 |

FOREIGN PATENT DOCUMENTS

| | | |
|---|---|---|
| 530 992 | 8/1931 | (DE) . |
| 17 29 825 | 11/1976 | (DE) . |
| 2543275 | 11/1976 | (DE) . |
| 3804781A1 | 6/1989 | (DE) . |
| 0581507A1 | 2/1994 | (EP) . |
| 894614 | 12/1944 | (FR) . |
| 403159 | 12/1993 | (GB) . |

* cited by examiner

*Primary Examiner*—Timothy V. Eley
*Assistant Examiner*—Dung Van Nguyen
(74) *Attorney, Agent, or Firm*—Wenderoth, Lind & Ponack, L.L.P.

(57) ABSTRACT

A grinding wheel includes a carrier wheel and a grinding layer formed on a peripheral surface of the carrier wheel. The grinding layer includes grinding segments and cup-shaped or scoop-shaped openings between the grinding segments.

1 Claim, 5 Drawing Sheets

GRINDING WHEEL

BACKGROUND OF THE INVENTION

The invention concerns a grinding wheel comprising a carrier wheel and a grinding layer arranged on the periphery of the carrier wheel. The grinding layer has a plurality of openings distributed over the periphery. The invention further concerns a grinding apparatus having a device for the feed of a coolant and/or lubricant.

Grinding wheels are already known in which segments provided with abrasive grain are mounted, for example by adhesive means, on the periphery of the grinding wheel. It is also already known that those segments can be arranged so as to be spaced apart from each other, and that liquid coolant and/or lubricant can be fed into the openings which are formed between the segments.

SUMMARY OF THE INVENTION

The object of the invention is to improve the known grinding wheels, in particular in regard to improved grinding qualities and a greater service life. This object is achieved by providing openings that are of a cup-shaped or scoop-shaped configuration (in a radial view) on the periphery of the grinding wheel.

In the state of the art, in a radial view of the periphery of the grinding wheel, the openings extend straight throughout the entire width of the grinding wheel, in a transverse relationship to the peripheral direction. However, the openings according to the present invention are of a cup-shaped or scoop-shaped configuration, that is to say they are delimited on both sides at least over a certain region thereof, so that the coolant and/or lubricant which is fed into the grinding region is retained in the transverse direction and thus enjoys enhanced residence in the grinding zone. That, however, does not necessarily mean that the openings have to be closed towards the peripheral edge of the grinding wheel. The openings may extend as far as the lateral periphery of the grinding wheel, that is to say they may be open towards the side. Nonetheless, cup-shaped or scoop-shaped configurations for the opening are formed, preferably by openings which are of a substantially V-shaped or U-shaped configuration. Whether laterally open or closed openings are employed and how wide the lateral apertures of those openings are, can be selected from the nature of the coolant feed, the amount of coolant and/or lubricant and the feed pressure.

Substantially V-shaped or U-shaped openings of that kind also make it possible to achieve an additional effect. Specifically, these openings guide coolant and/or lubricant from the peripheral edge of the grinding wheel towards the center (that is to say towards the tip of the V or towards the apex of the U). It is also possible for a plurality of V's and U's to be arranged in a row in side-by-side relationship so as to provide an overall, for example, serrated shape with respect to the openings. That therefore involves a hydrodynamic pressure build-up. Such grinding wheels with V-shaped or U-shaped openings which are distributed over the periphery thereof are generally linked to a direction of rotation, that is to say, the desired effect can only be achieved in one direction of rotation, more specifically, the direction in which the open end of the V or the U is moved in a forward direction and the closed end is at the rearmost position with respect to the direction of rotation of the grinding wheel. The applicants' tests have shown that such an arrangement actually makes it possible to achieve substantial improvements. For example, a lower level of power consumption, lower grinding forces (in particular normal forces), a cleaner ground finish without burn spots due to improved dissipation of heat, and the possibility of adopting higher feed values can be achieved. Contrasting tests in which the identical grinding wheel was operated in the reverse direction of rotation exhibited substantially worse results and, thus, indirectly confirmed the effect in accordance with the invention with substantially V-shaped or U-shaped openings, with such effect being linked to the direction of rotation involved.

BRIEF DESCRIPTION OF THE DRAWINGS

Further advantages and features of the invention will now be described in greater detail with reference to the specific description hereinafter.

DETAILED DESCRIPTION OF THE INVENTION

Figure 1:
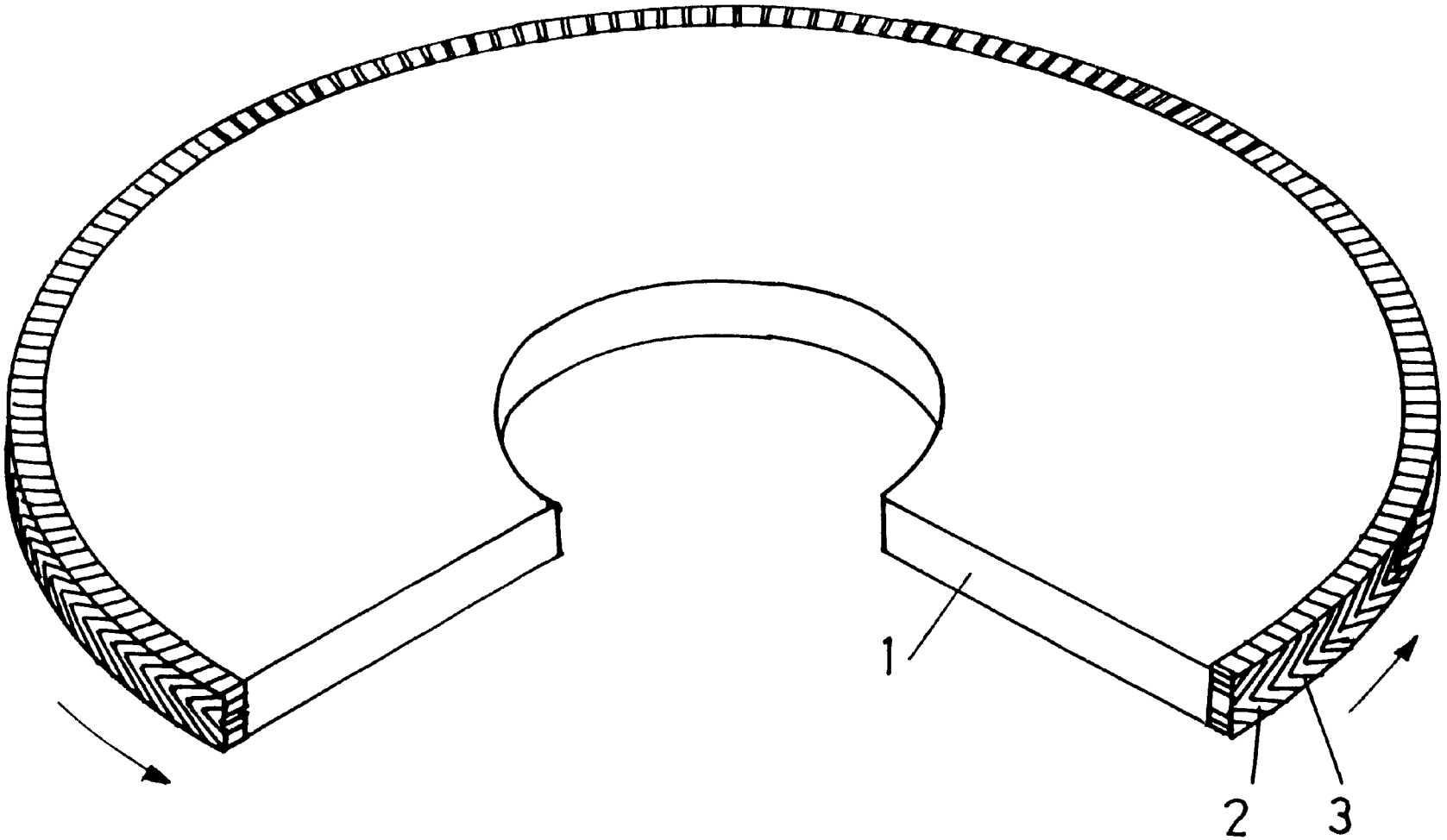
FIG. 1 is a partial perspective view of a first embodiment of a grinding wheel according to the present invention.
Figure 2:
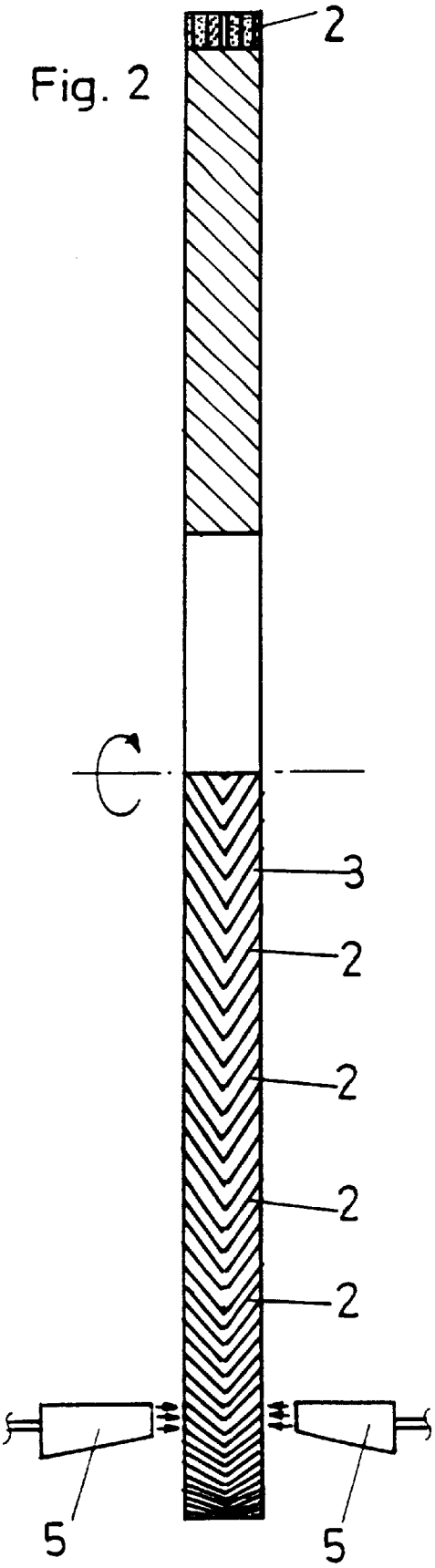
FIG. 2 is a partial peripheral view of the grinding wheel.

In the case of the grinding wheel shown in FIGS. 1 and 2, glued on a carrier or a carrier wheel 1 (for example, a steel, ceramic, damping carrier body, CF-carrier body) are a plurality of grinding segments 2 which are arranged so as to be spaced from each other in a peripheral direction of the grinding wheel. The abrasive grain (grinding agent) and the bonding mode may be of any desired nature. For example, corundum or CBN (cubic boronitride) are suitable grinding agents, and ceramic, synthetic resin or metal can be used as bonding agents.

In this case, the separate grinding segments have an arrow-shaped configuration so that provided between them are V-shaped openings 3 which are shown in black in FIGS. 1 and 2. In the radial view of the periphery of the grinding wheel (approximately in the middle of FIG. 2), those V-shaped openings have a cup-shaped or scoop-shaped configuration.

Figure 3:
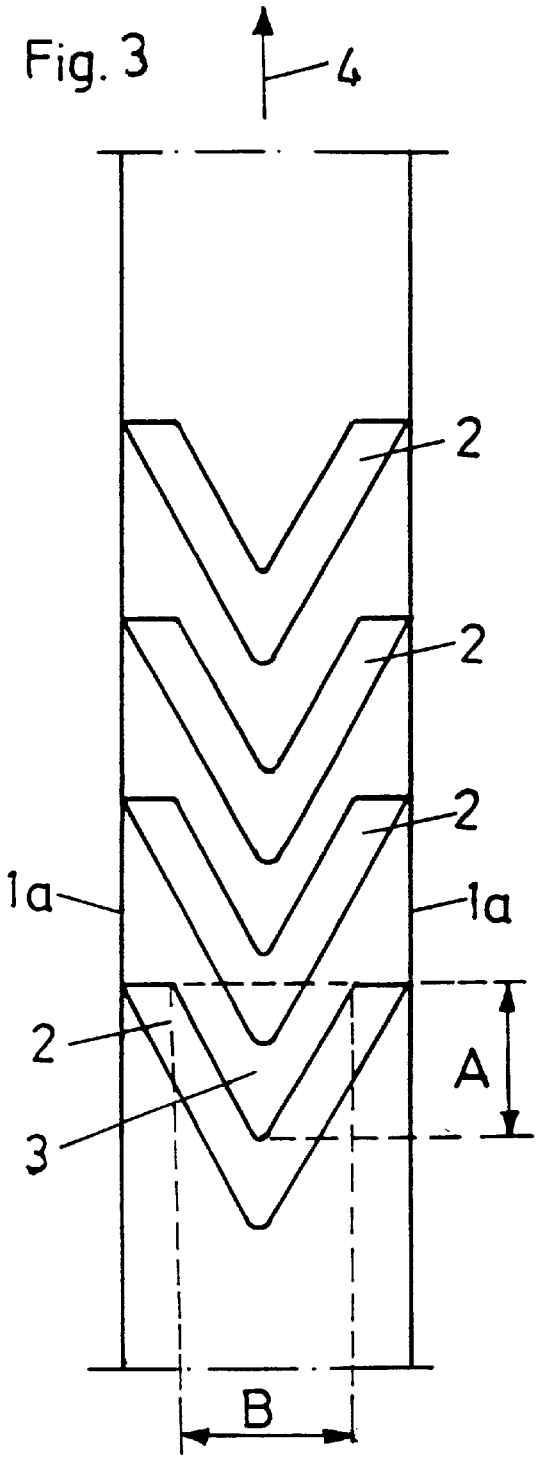
FIG. 3 is a detail view of part of the periphery of the grinding wheel according to the present invention.

In the embodiment illustrated in FIG. 3, V-shaped segments (for example a ceramic abrasive material) form substantially V-shaped openings 3 which are open at the lateral peripheral edge 1*a* of the wheel. Although the openings 3 are open at the side, there is nonetheless a cup-shaped or scoop-shaped region which is shown in the dotted line in FIG. 3 and which has a peripheral length A and a peripheral width B. That region is closed on both sides so that the coolant and/or lubricant cannot escape transversely with respect to the direction of movement 4 or the peripheral direction.

The laterally open openings 3 permit, for example, a feed of coolant from the side, as is provided by way of the devices 5 in FIG. 2. The coolant and/or lubricant which issues in liquid form from the nozzles of the devices 5 can penetrate from the side into the laterally open openings and is passed from there to the center of the grinding wheel by virtue of the V-shape of the opening.

Figure 4:
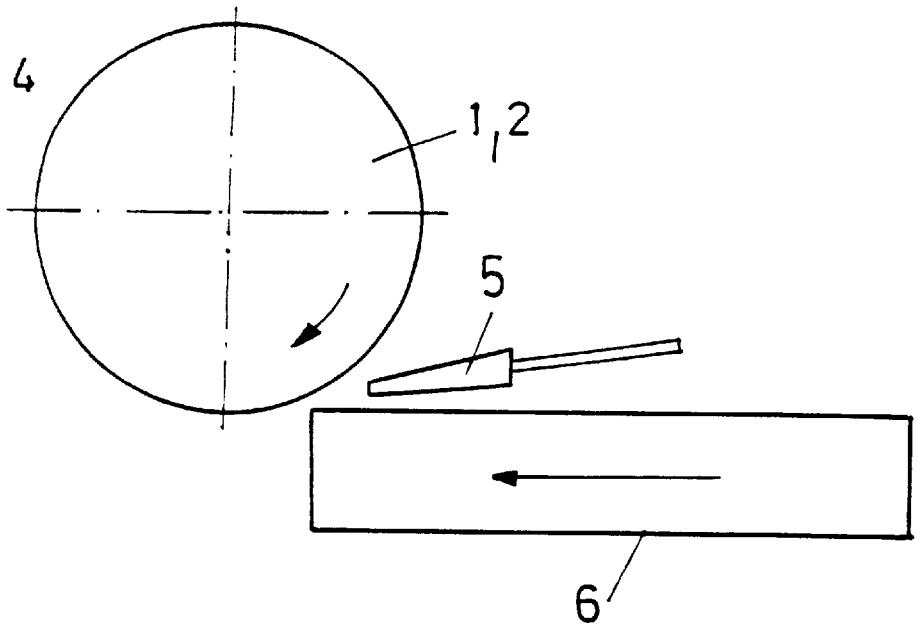
FIG. 4 is a diagrammatic side view of an embodiment of a grinding apparatus according to the present invention.
Figure 5:
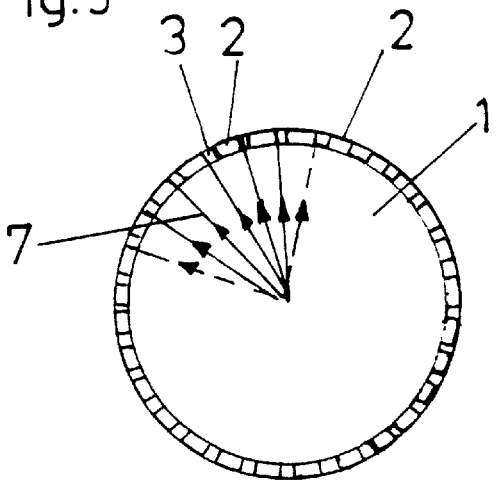
FIGS. 5 and 6 are section views showing two embodiments of a grinding wheel according to the present invention.

FIG. 4 is a highly diagrammatic view of a grinding wheel according to the invention and a device 5 for feeding coolant and/or lubricant, more specifically in a substantially tangential direction just above the region of contact with the workpiece 6. In accordance with the invention, grinding can be effected not only in the down-grinding mode but also in the up-grinding mode.

Besides the alternative configurations shown in FIGS. 2 and 4 for the feed of the coolant and/or lubricant, there is also the generally known possibility of passing the coolant and/or lubricant by way of radial passages 7 outwardly into the region of the openings 3. It will be appreciated that all possible forms of the coolant and/or lubricant feed can be combined together as may be desired.

Figure 6:
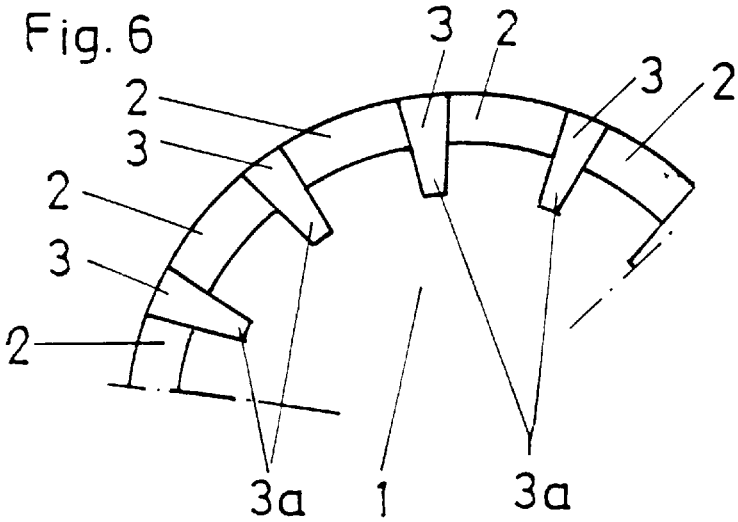

FIG. 6 diagrammatically shows a particularly preferred embodiment in which the radial extent of the opening 3 is greater than the radial thickness of the grinding layer or the grinding segments 2. In other words, here each opening 3 extends radially into the carrier wheel 1. The consequence of this is that, even when the grinding segments 2 are almost entirely ground away, there is still an available opening region 3*a* in the form of a cup-shaped or scoop-shaped region. Thus, instead of thicker grinding segments, it is possible to mount on the carrier a thin layer of abrasive grain which is preferably in the form of a single layer portion. The openings can then extend radially into the carrier. When thicker grinding segments are involved, to save on abrasive grain, the segments cab each contain a grinding agent, in particular abrasive grain, in a radially outer region, wherein the radial thickness of that outer region is less than the radial extent of the openings between the segments.

Figure 7:
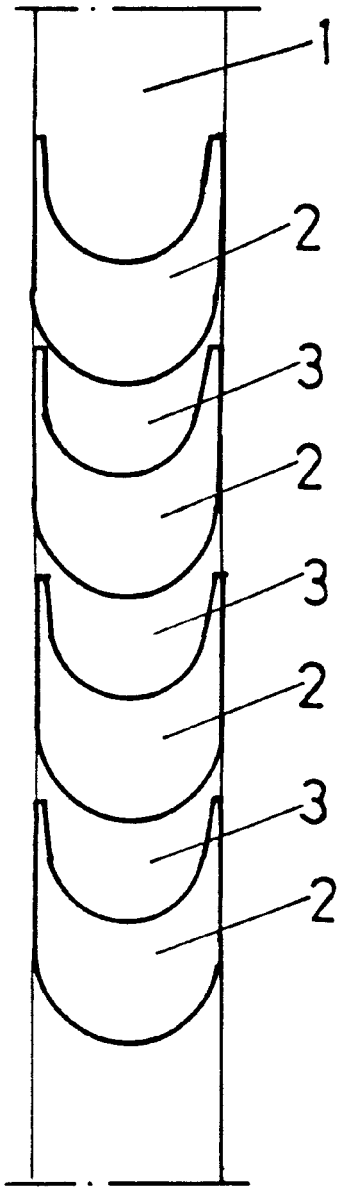
FIGS. 7 and 8 are peripheral vies each showing further details of the embodiments of grinding wheels according to the present invention.

In the embodiment shown in FIG. 7 the grinding segments 2 have a substantially U-shaped profile so that formed therebetween are substantially U-shaped openings 3 which (in a radial view of the periphery of the grinding wheel) are of a cup-shaped or scoop-shaped configuration.

Figure 8:
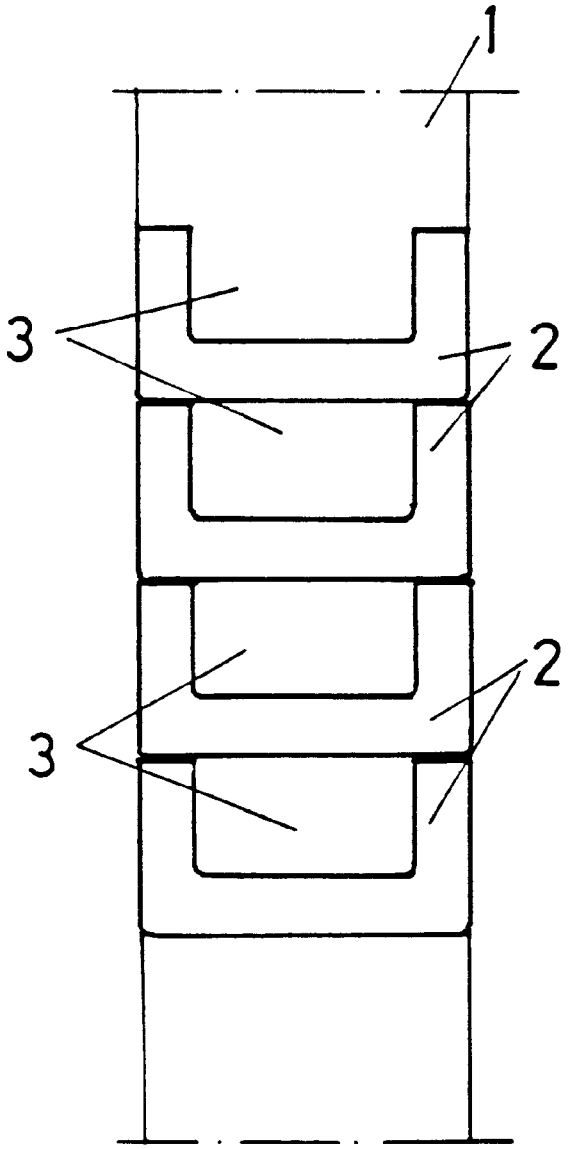

In the embodiment shown in FIG. 8, which is not linked to a given direction of rotation, the grinding segments 2 are angled twice at a right angle in a plan view and are arranged in a closely mutually adjacent relationship such that there is no orifice at the lateral sides ofthe grinding wheel, and therefore the arrangement forms substantially scoop-shaped openings 3. Unlike the situation involving U-shaped or V-shaped openings, this embodiment does not involve a directionally linked guide effect towards the center of the grinding wheel, but it will be appreciated that the laterally closed scoop-shaped openings are sufficient to achieve an improvement over conventional grinding wheels in which the openings are completely open towards the side.

Figure 9A:
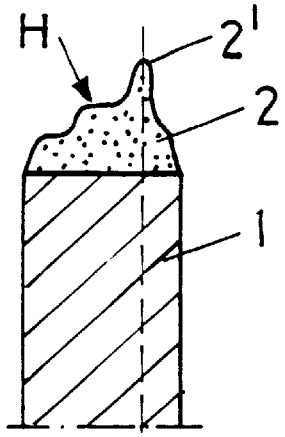
FIG. 9*a* shows a partial radial section view of an embodiment of a grinding wheel according to the invention.
Figure 9B:
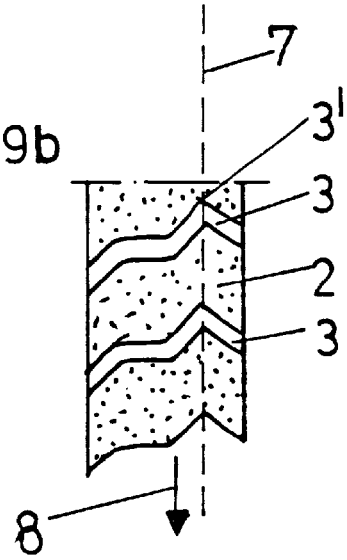
FIG. 9*b* shows a radial view onto the periphery of that grinding wheel.

In the embodiment shown in FIGS. 9*a* and 9*b* the diameter of the grinding wheel varies over the width of the grinding wheel. In other words, the grinding layer 2 mounted on the carrier 1 has a height profile H whose maximum (largest diameter portion) is identified by reference numeral 2'. That largest diameter portion 2' is most highly loaded in the grinding operation. By virtue of a specific configuration of the openings 3' as is shown for example in FIG. 9*b*, the invention now makes it possible to feed coolant most precisely to that largest diameter portion 2' insofar as, for example, the tip (closed end) 3' of a V-shaped region is the rearmost end of each opening with respect to the rotation direction 8 of the grinding wheel, and is at the same widthwise location (indicated by the broken line 7) as the largest diameter portion 2'. By virtue of that configuration, the coolant and/or lubricant is preferably conveyed to the widthwise location 7 and thus the height maximum 2' in the diameter of the grinding wheel is preferably cooled or lubricated.

In general, by virtue of a specific configuration of the openings, the invention makes it possible to implement specific and targeted distribution and feed of the coolant and/or lubricant.

Figure 10:
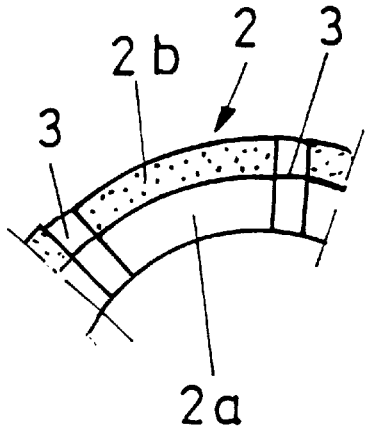
FIG. 10 is a longitudinal section view through the particular configuration of a grinding segment.

In the embodiment shown in FIG. 10, the grinding segment 2—viewed in a radial direction—has a different configuration, and only the radially outer region 2*b* having abrasive grain. The radially inner region 2*a* is free of abrasive grain. Nonetheless, each of the openings 3 extend in a radial direction through both regions 2*a* and 2*b*.

Figure 11A:
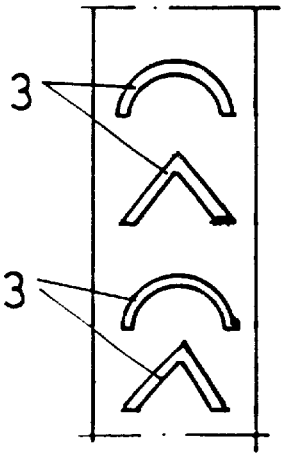
FIGS. 11*a* through 11*c* are highly diagrammatic radial views showing further options in terms of the possible shapes of the openings on the periphery of the grinding wheel.
Figure 11B:
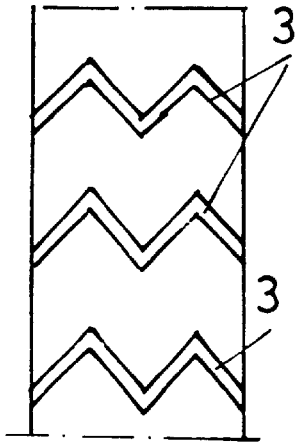
Figure 11C:
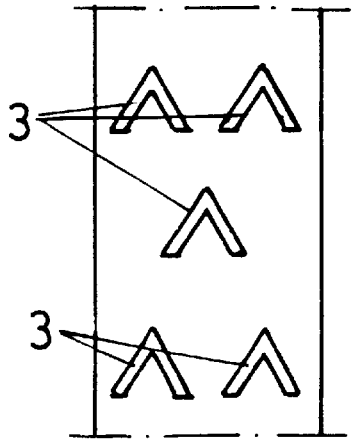

FIGS. 11*a* through 11*c* show further embodiments in regard to the arrangement of the openings 3. In FIG. 11*a*, U-shaped and V-shaped openings alternate, while in FIG. 11*b* two V-shaped openings are arranged in mutually juxtaposed relationship forming a generally "serrated" line. FIG. 11*c* shows V-shaped openings 3 which are distributed over the peripheral surface.

The invention is not limited to the illustrated embodiments. The shape of the segments or the openings formed therebetween may vary and, for example, a serrated shape for the openings is possible. The length and the dimensioning of the segments and the openings respectively can be adapted to the respective grinding requirements. In principle it is also possible to use a continuous grinding layer in which the openings are formed. In practice, however, making the grinding layer up from a plurality of segments which are arranged in a row with each other directly or at a spacing is probably more desirable: The term grinding wheel is to be viewed broadly and also includes copying or clearing tools.

What is claimed is:

1. A grinding wheel comprising:

a carrier wheel having a peripheral surface; and a grinding layer arranged on said peripheral surface of said carrier wheel and including a plurality of openings distributed over said peripheral surface of said carrier wheel, each of said openings having one of a substantially V-shaped configuration and a substantially U-shaped configuration so as to have an open end and a closed end with respect to a circumferential direction of said peripheral surface, said grinding layer having a varying diameter with respect to a widthwise direction of said peripheral surface and including a largest-diameter portion, said openings being arranged such that said closed end of each of said V-shaped and U-shaped openings is a rearmost portion of each of said openings with respect to a direction of rotation of the grinding wheel and is located on said peripheral surface at a location of said largest-diameter portion of said grinding layer with respect to the widthwise direction of said peripheral surface.

* * * * *